US010232236B2

(12) United States Patent
Shaad

(10) Patent No.: US 10,232,236 B2
(45) Date of Patent: Mar. 19, 2019

(54) SATELLITE GOLF CLUB CARRIER

(71) Applicant: Fritz Shaad, Boulder Creek, CA (US)

(72) Inventor: Fritz Shaad, Boulder Creek, CA (US)

( * ) Notice: Subject to any disclaimer, the term of this patent is extended or adjusted under 35 U.S.C. 154(b) by 232 days.

(21) Appl. No.: 15/142,692

(22) Filed: Apr. 29, 2016

(65) Prior Publication Data

US 2017/0312602 A1 Nov. 2, 2017

(51) Int. Cl.

| | |
|---|---|
| ***A45F 5/00*** | (2006.01) |
| ***A63B 55/10*** | (2006.01) |
| ***A63B 55/00*** | (2015.01) |
| ***A63B 55/20*** | (2015.01) |
| *A63B 69/36* | (2006.01) |
| *A63B 71/02* | (2006.01) |

(52) U.S. Cl.

CPC ..... *A63B 55/10* (2013.01); *A63B 55/20* (2015.10); *A63B 55/408* (2015.10); *A63B 69/3676* (2013.01); *A63B 2071/024* (2013.01)

(58) Field of Classification Search

CPC ..... A63B 55/00; A63B 55/10; A63B 55/007; A63B 55/008; A63B 55/005; A63B 55/20

USPC ..... 206/315.2, 315.1; 211/70.2; 248/166; 473/183, 176, 238, 282

See application file for complete search history.

(56) References Cited

U.S. PATENT DOCUMENTS

| | | | | | |
|---|---|---|---|---|---|
| 1,443,230 | A * | 1/1923 | Luckett | A63B 55/10 | 206/315.2 |
| 2,987,109 | A * | 6/1961 | Sohmer | A47C 15/004 | 108/118 |
| 2,990,864 | A * | 7/1961 | Zweben | B02C 18/305 | 241/65 |
| 3,058,504 | A * | 10/1962 | Powers | A63B 55/10 | 206/315.2 |
| 3,215,181 | A * | 11/1965 | Reed | A63B 55/10 | 206/315.2 |
| 3,353,838 | A * | 11/1967 | Schmid | A63B 55/10 | 280/47.19 |
| 3,483,996 | A * | 12/1969 | Scammon | A63B 55/10 | 211/207 |
| 4,371,022 | A * | 2/1983 | Goulart | A63B 55/10 | 206/315.2 |
| 5,755,322 | A * | 5/1998 | Yang | A63B 55/408 | 206/315.2 |
| 5,829,604 | A * | 11/1998 | Brophy | A63B 55/10 | 211/70.2 |
| 5,954,379 | A * | 9/1999 | Pikel | A45F 5/10 | 294/159 |
| 6,105,792 | A * | 8/2000 | Chang | A63B 55/00 | 211/70.2 |
| 6,536,588 | B1 * | 3/2003 | Kyrwood | A63B 55/408 | 206/315.2 |
| 7,077,274 | B2 * | 7/2006 | Laud | A63B 55/10 | 211/70.2 |
| 8,757,399 | B2 * | 6/2014 | Wolfbauer | A01K 97/08 | 211/60.1 |
| 9,931,553 | B1 * | 4/2018 | Ware | A63B 55/10 | |
| 2018/0085646 | A1 * | 3/2018 | Weiss | A45C 13/30 | |

* cited by examiner

*Primary Examiner* — Fenn C Mathew
*Assistant Examiner* — Cynthia Collado
(74) *Attorney, Agent, or Firm* — Walt Froloff

(57) ABSTRACT

A satellite golf club carrier for porting a club subset from a golfing cart to the hole shot, easing the port through a balanced carrier grip and a place to place a subset of clubs without scattering clubs on the golfing ground near tee-off follow on stroke shots.

8 Claims, 7 Drawing Sheets

SATELLITE GOLF CLUB CARRIER

CROSS-REFERENCE TO RELATED APPLICATION

This application claims priority to U.S. Provisional Application No. 62/179,229, filed May 1, 2015, which is incorporated by reference herein in its entirety.

BACKGROUND

Field of the Invention

The present invention generally relates to the field of golf accessories; and more specifically to a specialty golf club carrier to be used to carry a contingent set of clubs from the golf cart to the ball location after tee-off for quick and ready access to stroke follow-on shots.

Competing Products in the Field

There are several products in the field of the invention, but they have deficiencies. One such product stands on a tripod rather than being fixed in the ground. This makes the carrier less stable on inclines, wet slopes and mounds. The clubs are positioned with their club heads in the vertical up position. This adds imbalance and instability to the carrier because the center of gravity is high relative to the ground and any slight force could topple the carrier and as a consequence dirty or muddy the clubs and club handles. Because of the carrier imbalanced design more hand and arm strength is needed to carry and secure the carrier before the golfer actually takes a swing, diminishing players resources for the game. Also the clubs in these type carriers are held loosely and tend to slide out if tilted past a horizontal position while being carried. Further more these carriers also do not have as firm of a connection to the golf bag causing the bag and the clubs rattle while in transit on a motorized golf cart.

Golfers who use a motorized golf cart as a general rule do not take their golf bag off the motorized golf cart to finish their approach. Instead these golfers prefer walking to their ball or to the putting green if their ball is not yet on the green, hand carrying a putter and one or more golf clubs. Only when their ball landed on the putting green do golfers need only one golf club, which must be a putter.

But different golf clubs are needed to perform the shot that that typical the ball location may require. Usually the golfer carries a putter, sand wedge, 60° wedge, pitching wedge 9, and 7 iron in the golf club carrier throughout the round of golf, leaving one space open for a longer iron when needed for a long approach shot.

Another type of golf accessory is simply a holder device for keeping golf clubs up and off of the green. These types of accessories keep golf club handles off the ground but are not a carrier for golf clubs, and force the golfer to us the primary golf bag for carrying out to the green from the cart.

Another golf club carrier holds ten golf clubs, but in a horizontal position. It is not designed to be used with a motorized golf cart. If set on the ground it requires bending or stooping down to get the individual golf clubs in and out of the carrier. Yet another carrier is vertically positioned and plunges into the ground for anchoring but secures the golf clubs horizontally and does not attach to a motorized golf cart.

Another accessory, the golf club holding assembly holds golf clubs but they are carried with club heads up and handles in tubes, with a clubs limit of four. This is too limiting for many shots, is not as compact and unwieldy, does not appear to have as stable of a connection to the golf bag, does not connect directly to a motorized golf cart. Moreover if a motorized golf cart golf bag securing belt becomes loose the golf bag and carrier device will detach the motorized golf cart and fall. Furthermore this design does not have a radial bottom foot to give it 360° stability, but rather a rectangular one which does not protrude to the back of the device.

What are needed are satellite golf club carriers allowing golfer to carry clubs in a balanced loaded and stable while in a carrier. What are needed are carriers whereby clubs are held firmly so golfer hands and arms apply minimum tension and strength up while carrying the clubs back and forth from a motorized cart to the hole tee follow-on shots.

What are also needed are satellite carriers which secure clubs so that they do not slide out if tilted past a horizontal position while being carried. Also carriers that have firm connection to the golf bag eliminating club rattle while in transit on a motorized golf cart.

What are needed are golf club carriers which can be vertically positioned but secure, to reduce stooping and bending to select clubs for shot. Also needed are carriers in bags or brackets with a quick but stable direct connection to a motorized cart for intra hole porting.

SUMMARY

The present invention discloses a satellite golf club carrier comprising a shaft having a handle rigidly coupled to the shaft at the first end of the handle, and the second end of the handle rigidly couple to a carrier grip, the carrier grip with length between 13-36 inches. A spindle is firmly and concentrically attached to the shaft, the spindle having a thickness and embedded slots concentric to the spindle center. A spindle slot has two ends, the first slot end nearest spindle center is circular for firmly holding a slidably insertable golf club shaft and the second slot end a narrow constant width channel open from the spindle outer edge to the circular and also the spindle having an attachment arm assembly with front and back parallel plates, assembly attachable and detachable to a slotted bracket for golf bag attachment-detachment. A club spacer disk is concentric with and rigidly coupled to the carrier shaft, for uniformly separating spindle populated clubs, spacer is positioned on the shaft between the spindle and a collar, the shaft collar, a disk-like component rigidly attached and concentric to the carrier shaft towards the shaft ground distal end, is positioned near the shaft ground or spindle inserted club head end for providing a stable vertical stationed carrier orientation and ground shaft insertion stopping position, whereby the satellite golf club carrier can be loaded with a contingent set of clubs for a particular golf hole shot and be detached from a golf bag for porting to the shot position with a subset of four to seven clubs.

BRIEF DESCRIPTION OF DRAWINGS

Specific embodiments of the invention will be described in detail with reference to the following figures.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

OBJECTS AND ADVANTAGES

Current golfing practice has golfer choose a set of golf clubs s/he might need for a particular hole, then carry them to the ball location, select the immediately needed club and leave the remaining golf clubs on the ground. This leaves the clubs on the ground potentially dirty, wet and are often left behind. If the club needed is not in the set carried out to the hole, the golfer must return to the golf cart for a different golf club. Using an invention carrier embodiment, the golfer has up to seven pre-selected golf clubs in the club carrier which decreases the chances of needing a golf club that the golfer does not have at the ball location. This saves the time it takes to pick out and return the golf clubs to the golf bag for each approach, bending over and picking up dirty, unorganized golf clubs or leaving clubs behind as the golfers rush off to the next hole. In addition, the golf club carrier stands vertically which makes it difficult to forget and leave behind. Thus an object of the invention is to provide a golfer more time, energy and mental focus to spend on playing his round of golf by automating the logistics of club selection.

The present invention discloses a satellite golf club carrier. Other objects of the invention are as follows:

A balanced loaded for carrying carrier, and stable while carrier loaded with clubs is free standing.

That clubs in the carrier are held firmly so that a golfer's hands and arms do not feel a weight moment from the loaded carrier and thus require minimum tension and strength up while carrying the clubs in the carrier.

Carriers which secure clubs so that they do not slide out if tilted past a horizontal position while being carried.

Carriers that have firm connection and dampening to the golf bag eliminating club rattle while in transit on a motorized golf cart.

Carriers should be vertically positioned but secure, to reduce stooping and bending to select clubs for shot.

Carriers in bags or brackets with a quick but stable direct securing to a motorized cart.

Embodiments of the Invention

Figure 1:
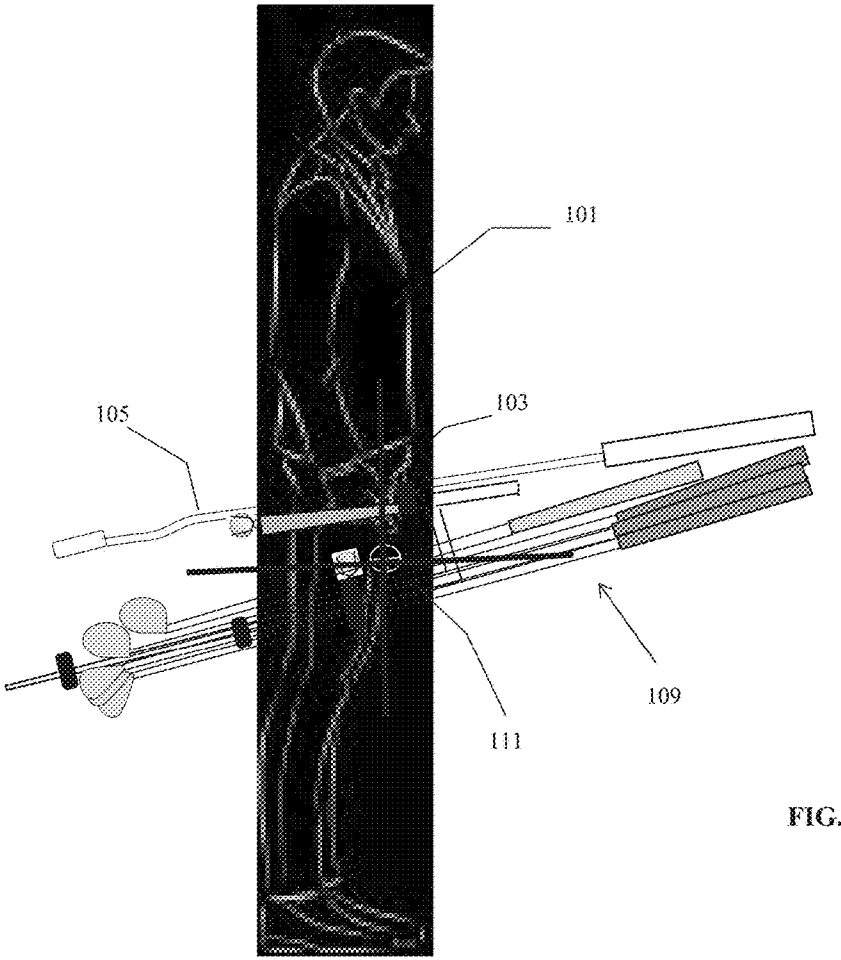
FIG. 1 illustrates club carrier with golf clubs attached and in a carrying position in an embodiment of the invention.

FIG. 1 illustrates club carrier with golf clubs attached and in a carrying position in an embodiment of the invention.

The exact shot hit at any given time on a golf course, and which club is used to accomplish the shot or sequence of shots, is always completely at the discretion of the golfer 101. Which club a golfer 101 may or may not use at any time for any shot is highly dependent on the golfer 101 and the situation. Therefore the golfer 101 will carry a selection 109 of clubs for a particular hole and shot off the cart and to the teeing spot. The large headed putters 105 may require some separation from the other clubs during the porting to illuminate club head collisions and banging noise and damage from the clubs.

In an embodiment of the invention the club carrier has a carrier grip handle 103 between 13 and 36 inches long for providing adequate length for balanced purchase or grip-position on the grip handle while carrying an assortment of golf clubs in the carrier 109. The grip handle 103 configuration and length allows the golfer to move his grip-point forward or backward on the grip handle 103 to quickly find the balance point 111, loaded carrier center of gravity, while porting a subset of clubs in more-or-less horizontal position of the carrier 109. An balance carrier port of the club set relives the golfer 101 of swinging club torques or moment arm working the golfers hands and is easily balanced while carrying a contingent of clubs.

Figure 2:
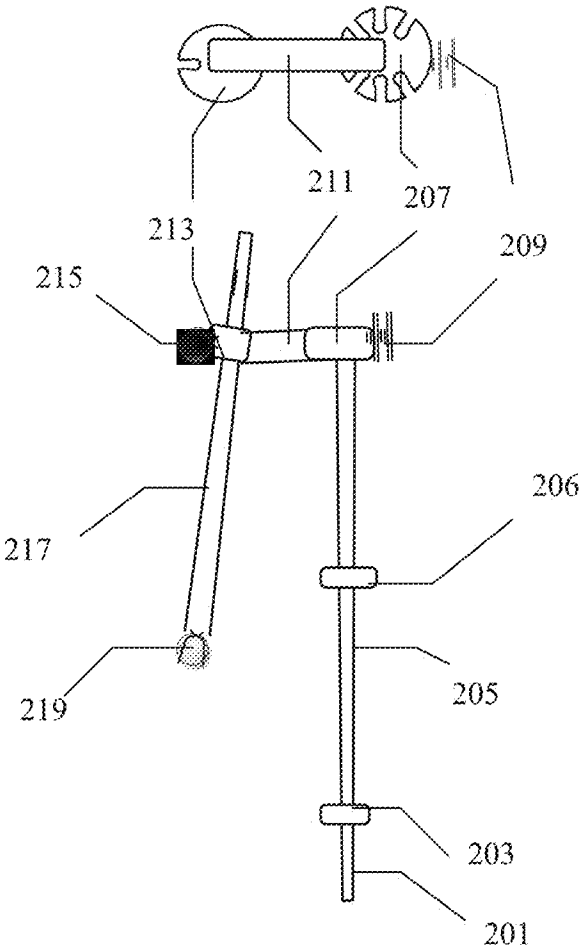
FIG. 2 illustrates a bare satellite club carrier side and top in an embodiment of the invention.

FIG. 2 illustrates an unloaded satellite club carrier side and top view in an embodiment of the invention. In and embodiment the carrier has a rigid tubular or bar shaped grip handle 217 having two ends. The carrier grip handle 217 end 219 can provide an attachment for a spare golf ball 219 or golf towel attachment for easy access, sparing the golfers pockets of objects which could potentially interfere with their swing.

The grip handle 217 is rigidly coupled to a first end of the carrier handle 211. The carrier handle 211 is rigidly coupled to a shaft off angle at the second end. The carrier handle 211 is used when planting the carrier vertically into the ground and for removal. The club carrier handle 211 allows for a full-hand purchase and vertical force when installing into or removing the carrier shaft 205 201 from the ground.

The carrier shaft 207 supports the bulk of the golf clubs via a spindle 207 near the top and spacer 206 midway along the shaft 205, and a collar 203 which are all concentric to and rigidly coupled to the carrier shaft 205. The spindle 207 has a rigidly coupled parallel plate pair 209 oriented for attaching the carrier shaft 205 to a golf bag through a bracket arrangement.

Figure 3:
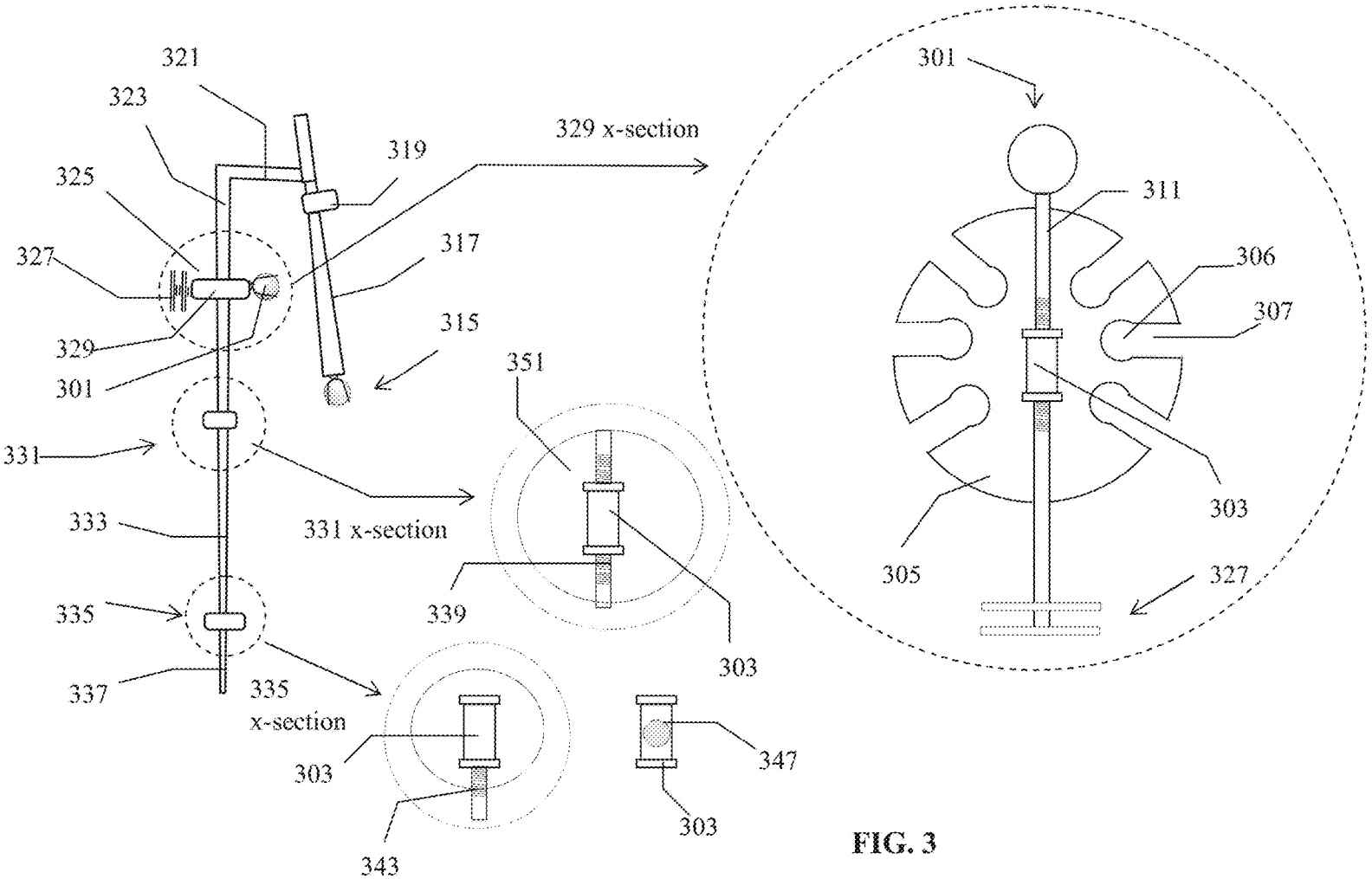
FIG. 3 illustrates a satellite club carrier assembly components in an embodiment of the invention.

FIG. 3 illustrates a satellite club carrier assembly components in an embodiment of the invention. The golf club carrier backbone is the carrier shaft 323 333 337 which is rigidly coupled to a spindle assembly 325, spacer 331 and a collar 335 through their centers along the carrier shaft 323 333 337.

The club carrier shaft 323 333 337 is a round steel rod that runs the entire length of club carrier. The shaft 323 333 337 can also be of and I-beam or tube cross-section and made from metal, composite, plastic, or other strong rigid material.

A carrier handle 321 is rigidly coupled to the shaft 323 333 337 towards the top end of the shaft 323 at more-or-less right angles. The handle 321 is used when planting the carrier vertically into the ground and for removing once the hole is completed and the golfer is moving on. The club carrier handle 321 allows for a full-hand purchase and vertical force when installing into or removing the carrier shaft 337 from the ground. The club carrier handle 321 is roughly tubular or bar shaped having two ends. The first end is rigidly o rigidly coupled to the shaft 323 at more or less 90 degrees and the second end is rigidly coupled to a grip handle 317 at greater than a 90 degree angle with the grip handle. The grip handle 317 is also tubular in shape but can be of various construction with the structural grip handle 317 inside including I-beam, rod, tube, metal, plastic, poly-xx, composite, wood or combinations of those. The grip handle 317 distal end(s) can support a holder 315 for a spare golf ball or golf towel attachment for easy access.

A decorative golf ball can be attached to the grip 317 to help prevent the club carrier grip from slipping through the golfer's hands when carrying and balancing club carrier in a more-or-less horizontal position.

Carrier Spindle

In an embodiment of the invention the club carrier spindle assembly 329 is configured for the insertion of one to six golf clubs installed in the spindle slots 307, slots 307 concentrically arranged about the spindle center 303. Installed golf clubs are aligned more or less parallel to the carrier shaft 303 323, with club heads face towards the shaft collar 335 and ground anchor end. This carrier configuration also provides both stability and balance by creating a compact and low center of gravity loaded carrier, or as slots are populated with golf clubs. The clubs are inserted and removed with little effort because of the spindle slot 306 307 shape. Fully inserted and lowered the spindle 329 provides a firm hold on the golf club shaft through gravity and friction forces. Since the clubs are also held firmly by slot-club shaft friction and gravity due to the slot configuration, the clubs do not slide out of the holding slots even when club carrier is tilted forward or at and angle below the horizontal while being carried.

Carrier Spindle Slots

The club carrier spindle has four to six slots concentrically aligned slots. Each slot has an open end 307 at the spindle edge and a circular configured end 306 toward the spindle center. Upon club insertion into the slot 307 outer spindle end with the club small shaft diameter end, moving the club shaft to the circular slot end 306 and lowering the club shaft until the club tapered shaft coincides snuggly with the spindle slot circular end 306. The slot is designed so that the golf club shaft can be inserted into the open end slot at a relatively small diameter point just above the club head with club head facing toward shaft ground anchor end, and moved downward to a point where the club expanding taper shaft diameter exceeds the slot diameter. Where the tapered club shaft meets flush with the carrier spindle slot circular end diameter, gravity and friction forces hold the clubs firmly in place. Upon club removal, the club is moved upward to a point whereby the club shaft diameter taper to equal the straight portion 307 of the slot leaving sufficient clearance in the slot to pull the club shaft out of the slot circular portion 306 and through the straight portion 307 of the slot. The club carrier spindle slot 306 307 dimensions accommodate most golf club shaft diameters used on the approach, course grounds and on the putting green. Alternate spindle slot configurations in alternate embodiments may include spindles with spokes having the insertion slots at the distal ends.

An attachment arm assembly 327 with front and back attachment plates 327 is firmly coupled to the spindle edge 305 to support the full weight of a fully loaded carrier. In an embodiment of the invention fasteners are used for a rigid coupling but solid molds and other attaching methods are also contemplated. The parallel plates 327 are oriented away from the carrier center 303 end and parallel with a bracket attachment slot.

Golf Club Spacer

A club spacer 331, a disk concentric with and rigidly coupled to the carrier shaft 303 333. The spacer 331 is positioned on the shaft 333 between the spindle and collar and maybe rigidly coupled to the shaft 303 vi fasteners 339 or alternate coupling methods can be used. The spacer 331 damps any golf club rod vibration against carrier shaft 333 and reduces free play from clubs during golf club porting. The spacer 331 can be plastic, metal, composite, wood, rubber, or combinations.

Carrier Collar and Shaft End

A club carrier shaft collar 335 is a stiff disk component rigidly attached and concentric to the carrier shaft 303 towards the shaft 337 ground distal end. The collar 335 is placed near the shaft 337 anchor end and provides a stable vertical stationed carrier orientation when planted in the ground. The collar also provides a shaft to ground insertion stopping position, adding stability and balance to the carrier by distributing the carrier load more or less evenly over the collar 335 surface area in flush contact with the ground surface when carrier shaft 337 is planted.

The club carrier shaft 323 333 337 is a round steel rod 347 that runs the entire length of club carrier shaft. The length of the shaft 337 below shaft collar 335 is of sufficient depth such, between 4 and 12 inches, that when inserted provides stability for club carrier upon full ground penetration. Ground insertion depth should not exceed a depth which will bring the shaft into contact with underground utilities, dimension. The shaft 303 can be a rod 347 with circular cross section or I-beam of various types. The material of the shaft 323 333 337 can be metal or composite, plastic, wood, or combinations and is of sufficiently strong rigid construction to carry the various components attached with the clubs.

Bracket Attachment Plate Assembly

The parallel plates 327 attachment assembly provides connective stability when attached to an attachment bracket. A bracket and plates are especially needed on rough terrain as they minimize vibration and rattle from the clubs by opposing parallel plate pressure in the bracket from opposite bracket wall sides. The plates have click-in-out or snap attachment mechanisms for insertion to and removal of the club carrier to or from a golf bag attachment bracket or golf cart attachment bracket.

Figure 4:
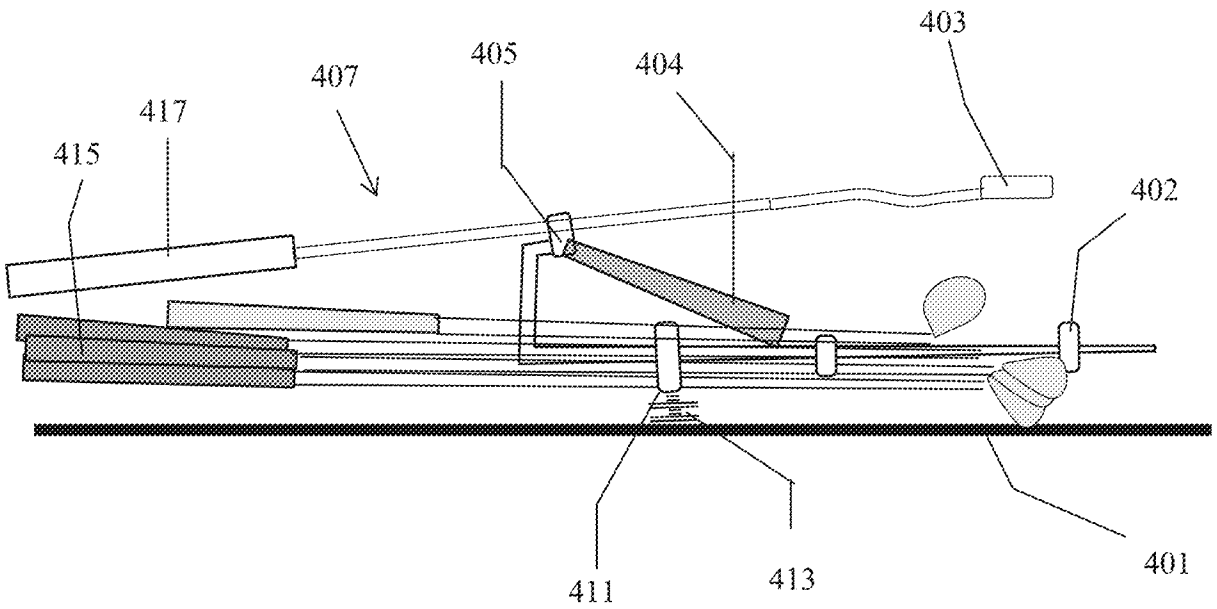
FIG. 4 shows a satellite club carrier with golf clubs held in position off the surface in a horizontal resting on front and back parallel plate bracket attachment arm.

FIG. 4 shows a satellite club carrier with golf clubs off the surface in a horizontal position resting on front and back parallel plate bracket attachment 413 coupled to the spindle 411. The loaded carrier 407 is shown on hard or fragile horizontally surfaces 401 as found on a golf course such as hard pan, cart path, parking lot or putting green while keeping the golf club handles clean and dry. The carrier has a separate coupler 405 adjacent the grip handle for a putter attachment which allows for putters with large heads 403 head and oversized grip 417 from collision damage from proximity to the more resilient clubs. The coupler 405 keeps the putter separated from the other clubs 415 in the golf club carrier so the putter head 403 will not be damaged and noise from head collisions will also be reduced or eliminated.

In another aspect of the invention the grip handle 404 has one end bent toward the shaft collar or connected to the shaft between the spindle and the shaft collar 402. This design provides some advantages in manufacturing without sacrificing the grip handle length advantage for holding position adjustment to above a loaded carrier center of gravity.

Figure 5:
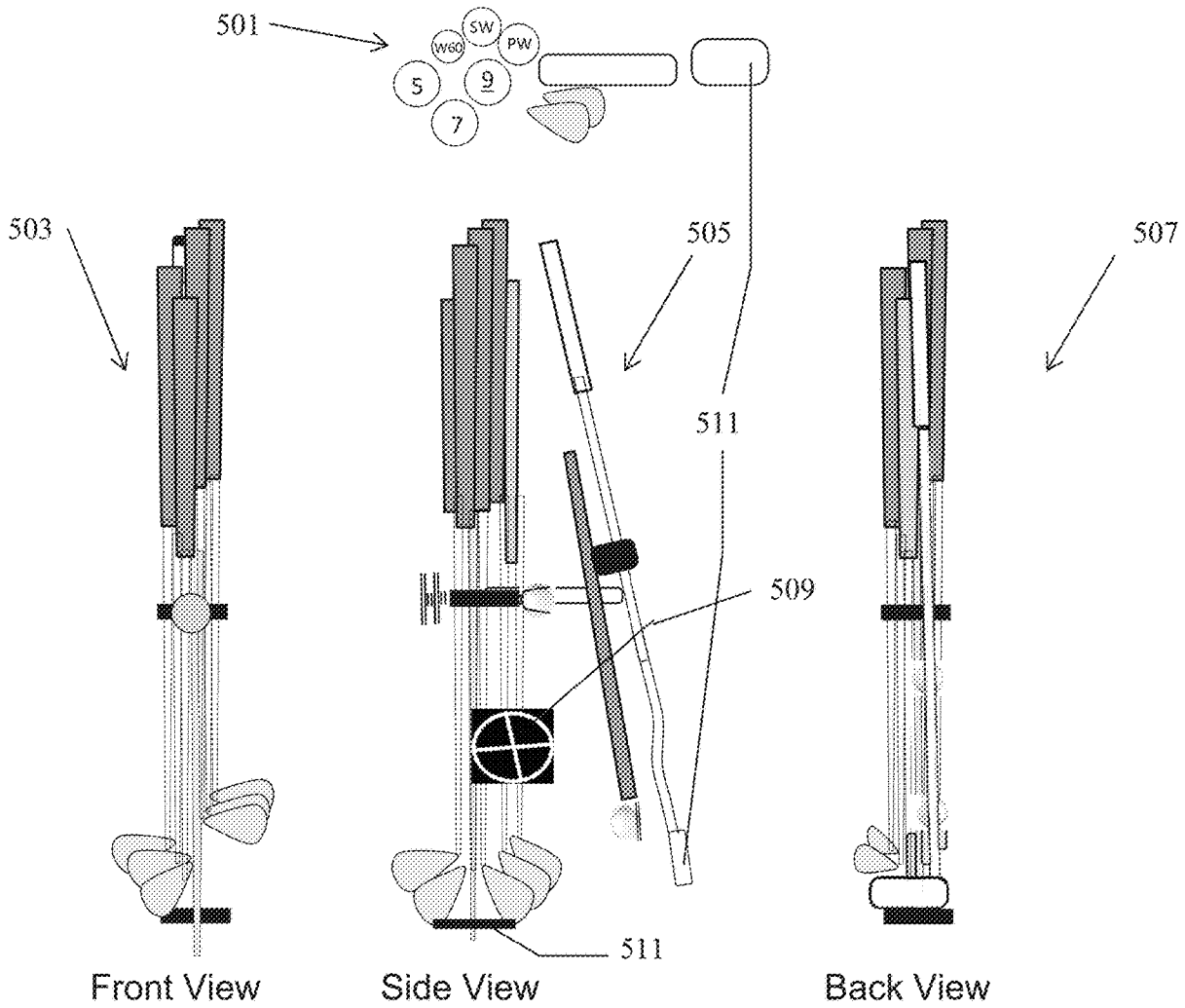
FIG. 5 illustrates a satellite golf club carrier top, front, side and back view of club carrier with golf clubs in a vertical position with club carrier shaft penetrating ground-up to club carrier shaft collar.

FIG. 5 illustrates a satellite golf club carrier top 501, front 503, side 505 and back 507 views of club carrier with golf clubs standing in a vertical position with club carrier shaft penetrating ground-up to club carrier shaft collar 511. This radial design provides for carrying from one to seven golf clubs in a compact manner with a low center of gravity 509 which makes penetration and removal from the ground easy. The grip handle provides a snap-on shaft-to-shaft coupler for a putter to be attached separate from the spindle slots. This provides for putters 511 with large heads, head protector and an oversized grip to be carried apart from but together with the other clubs so that the putter head 511 will not be damaged. The loaded carrier stands vertically on fairway, rough, or on the edge of the putting green when its haft spike is inserted into the ground keeping the golf clubs clean and dry with easy club removal and replacement.

Figure 6:
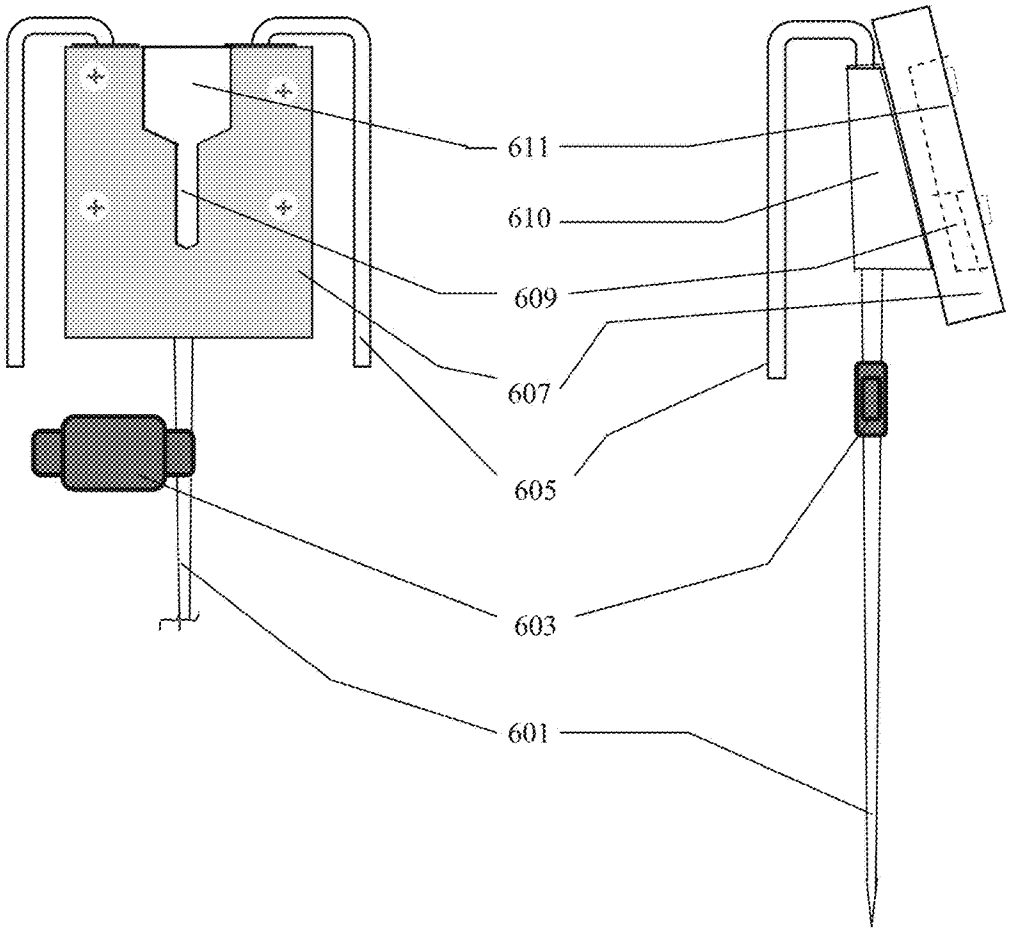
FIG. 6 Shows the side and front view of a golf bag attachment bracket in an embodiment of the invention.

FIG. 6 Shows the side and front view of a golf bag attachment bracket in an embodiment of the invention. A docking head 607 is the main body of the bracket, having two compartments, a front side 607 and a backside 610. The head 607 front side contains a docking slot 611 facing a club carrier. The docking head 607 backside 610 faces a golf bag. The bracket backside 610 has attachment rods 605 rotatably coupled to the top of the docking head backside 610 bag facing side, the rods bent in an upside-down J rod with the straight long portion of the J extending outward and downward to a short length below the docking head 607 backside, just enough to hook into and secure the bracket to a golf bag when the J rods are inserted into a golf bag with the bracket backside 610 hanging outside of the golf bag and the J rod resting on the golf bag rim and inside of the golf bag.

The bracket backside 610 has down rod 601 rigidly coupled to the bottom of the docking head backside 610 compartment and extending a length straight down. The down rod 601 is coupled to a slidable belt buckle 603, which accommodates a belt wrapping around the golf bag and securing the bracket body to the golf bag so that there is no attachment bracket swing side to side.

The slot open end 611 matches the width of a front plate of the carrier attachment arm parallel plate assembly pair, the front plate which can be inserted into the open end slot 611 and moved down into the narrow part of the slot 609 of the bracket docking head 605. This locks the front plate into the attaching bracket providing an attachable-detachable coupling with the club carrier.

The bracket back attachment rod 601 moment pressure against the golf bag and golf bag belt 603 provide a firm couple between the bracket and the golf bag, but allow the club carrier to be easily attached/detached to most all golf bags and motorized golf carts.

Figure 7:
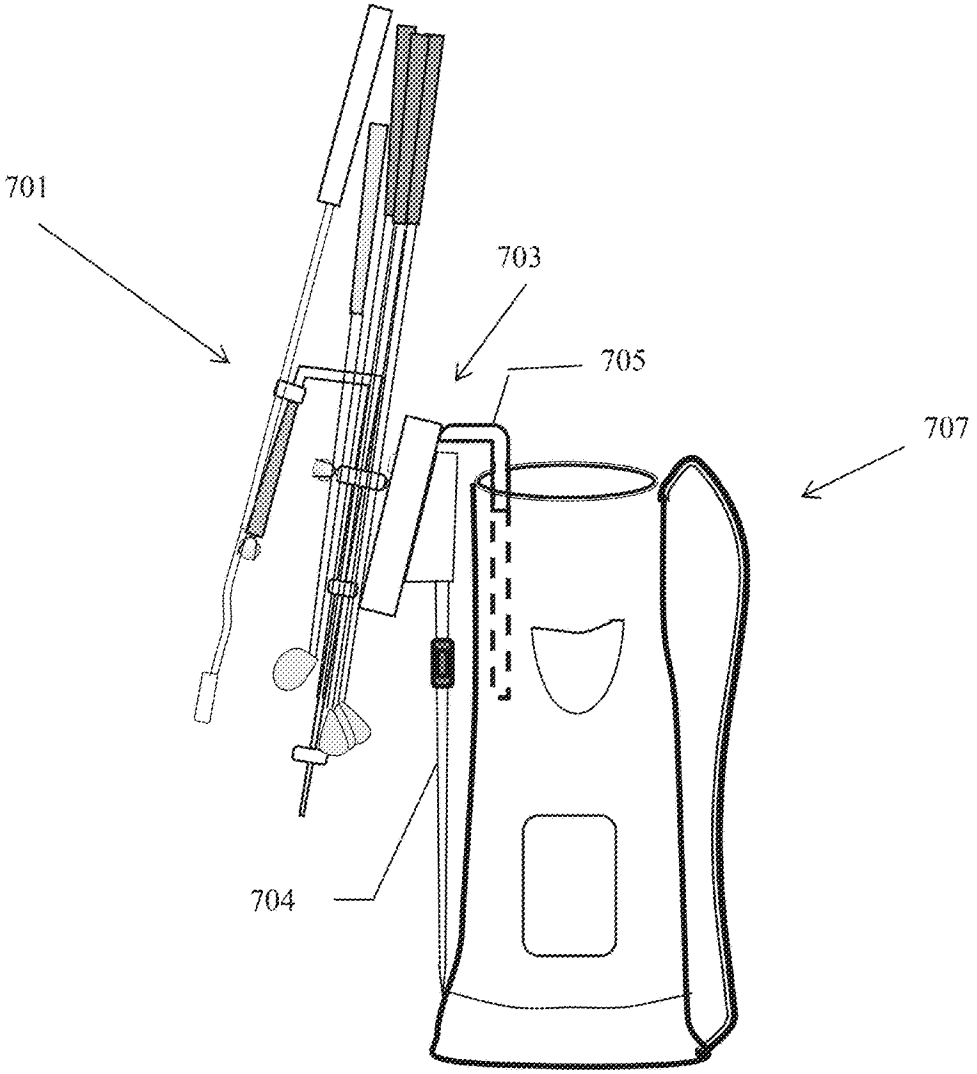
FIG. 7 Illustrates a carrier attachment bracket serving to attach the carrier to a golf bag on a motorized golf cart attachment in an embodiment of the invention.

FIG. 7 Illustrates a carrier attachment bracket serving to attach the carrier to a golf bag for a golf cart porting in an embodiment of the invention. Bag attachment rod(s) 705 secure the golf bag attachment bracket 703 to golf bag 707, pressed from without and within by parallel bracket attachment 703 rods 704 705. The bag attachment rods 704 705 allow for different positioning of golf bag 707 on motorized golf cart. Adjustments to open and close gaps can be made rotating the upper J rod hook(s) in or out which gives the hooks the ability to snuggly fit the different sizes of golf bag 707 club carrying compartment. The securing buckles on the bag attachment rods 704 can be moved up or down to allow for different heights of the motorized golf cart bag securing belt relative to golf bag 707 design.

The bracket rod securing buckles 704 make use of the motorized golf cart bag securing belt which may or may not loop through the golf bag handle 707. This will depend on golf bag 707 mount position on motorized golf cart. By threading the motorized golf cart bag securing belt through the securing buckles 704 and motorized golf cart bag securing buckle 707, then tightening and locking the motorized golf cart bag securing buckle and locking securing buckles, the universal golf bag attachment bracket 703 and golf bag 707 are securely attached to a motorized golf cart.

An embodiment universal golf bag attachment bracket is designed for a quick easy insertion of the over hanging bracket rods into the golf bag with securing buckles attaching to the bag body while mounting on golf bag. As shown the in FIG. 3 and FIG. 6 the attachment assembly coupled to the spindle with a rigid protruding stem having two parallel plates more-or-less perpendicular to the stem are used for attaching-detaching from a mating bracket attachable to a golf bag or motorized golf cart assembly. Other attachable-detachable coupling mechanisms available can be used embodiments.

The docking head is the bracket body 607 that contains a docking slot 611 609 through which a carrier attachment assembly front parallel plate will insert through the parallel plate matching bracket slot opening. Once the front plate is through the matching shape slot portion the carrier plate supports will slide down into the narrow neck of the bracket slot securing the plate against the bracket. Securing the golf bag belt through the bracket buckle 603 further reduces any loosing motion between the bracket attachment and the golf bag.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. A satellite golf club carrier comprising:

a golf club carrier shaft having a handle rigidly coupled to the shaft at a first end of the handle and rigidly coupled to a carrier grip at a second end of the handle;

the carrier grip having a length between 13 and 36 inches;

a spindle firmly and concentrically attached to the shaft, spindle having a thickness and embedded spindle slots concentric to the spindle center;

the spindle slot each with two ends, a first slot end nearest spindle center is circular for firmly holding a slidably insertable golf club shaft and a second slot end having a narrow constant width channel open from the spindle outer edge to the circular end;

the spindle having an attachment arm assembly with front and back parallel plates, assembly attachable and detachable to a slotted bracket;

a club spacer disk concentric with and rigidly coupled to the carrier shaft, for uniformly separating spindle populating clubs, spacer is positioned on the shaft between the spindle and a collar; and a shaft collar, a disk-like component rigidly attached and concentric to the carrier shaft towards the shaft ground distal end, and positioned near the shaft ground or spindle inserted club head end for providing a stable vertical stationed carrier orientation and ground shaft insertion stopping position, whereby the satellite golf club carrier can be loaded with a contingent set of clubs for a particular golf hole shot and be detached from a golf bag for porting to the shot position with a subset of four to seven clubs.

2. A satellite golf club carrier of claim 1, wherein the carrier grip handle are angled away or toward the shaft.

3. A satellite golf club carrier of claim 1, wherein the carrier shaft cross-section is from a group of cross-sections consisting essentially of a tapered shaft, I-beam and tubular.

4. A satellite golf club carrier of claim 1, wherein the carrier shaft material composition is from a group of materials consisting essentially metal, plastic, thermoplastics, composite and wood.

5. A satellite golf club carrier of claim 1, wherein the carrier spindle, spacer and collar are coupled to the shaft via fasteners, adhesives, molding, cast, thermoforming or combinations of manufacturing processes.

6. A satellite golf club carrier of claim 1, further comprising a shaft with taper coupled to I-beam components for coupling the spindle, spacer and collar.

7. A satellite golf club carrier of claim 1, further comprising attachment assembly coupled to the spindle with a rigid protruding stem having two parallel plates more-or-less perpendicular to the stem, plates for attaching-detaching from a mating bracket attachable to a golf bag or motorized golf cart frame assembly.

8. A satellite golf club carrier of claim 1, further comprising a separate coupler adjacent the grip handle for a putter, to eliminate putter damage as putters have with larger heads and oversized grips are more susceptible to damage in proximity to other clubs during transport.

* * * * *